US011700949B1

(12) United States Patent
Zhu

(10) Patent No.: US 11,700,949 B1
(45) Date of Patent: Jul. 18, 2023

(54) FOLDING BED

(71) Applicant: Jiangxi Bonika E-commerce Co., Ltd, Fuzhou (CN)

(72) Inventor: Junfeng Zhu, Fuzhou (CN)

(73) Assignee: Jiangxi Bonika E-commerce Co., Ltd, Fuzhou (CN)

( * ) Notice: Subject to any disclaimer, the term of this patent is extended or adjusted under 35 U.S.C. 154(b) by 0 days.

(21) Appl. No.: 18/170,515

(22) Filed: Feb. 16, 2023

(51) Int. Cl.
*A47C 17/72* (2006.01)

(52) U.S. Cl.
CPC ..... *A47C 17/72* (2013.01)

(58) Field of Classification Search
CPC ... A47C 17/82; A47C 17/72; A47B 2003/006; A47B 2003/045; A47B 13/003; A47B 3/002; A47B 3/10; A47B 3/087
USPC ..... 5/116
See application file for complete search history.

(56) References Cited

U.S. PATENT DOCUMENTS 6,457,192 B2 * 10/2002 Choi ..... A47C 4/286 5/112
9,756,950 B2 * 9/2017 Choi ..... A47C 19/126
2004/0000009 A1 * 1/2004 Choi ..... A47C 19/126 5/174
2008/0295246 A1 * 12/2008 Yul ..... A47C 17/16 5/12.2
2009/0139026 A1 * 6/2009 Chen ..... A47C 19/126 5/111
2014/0013504 A1 * 1/2014 Chen ..... A47C 19/122 5/400
2021/0259430 A1 * 8/2021 Frankel ..... A47C 19/126

FOREIGN PATENT DOCUMENTS

CN 106510284 A 3/2017
CN 215738014 U 2/2022
CN 216932494 U 7/2022

* cited by examiner

*Primary Examiner* — David R Hare
*Assistant Examiner* — Adam C Ortiz
(74) *Attorney, Agent, or Firm* — Nitin Kaushik

(57) ABSTRACT

The invention relates to a folding bed, belonging to the field of furniture, comprising a mattress, a pillow and a bed frame. Seven X-shaped support frames are adopted to constitute a main structure of the bed frame, and an upper edge of the X-shaped support frame is provided with foldable support rods and connecting pieces. The whole structure may be folded longitudinally and transversely to form a columnar body after folding, which can sufficiently reduce the gap between the support rods, so as to minimize the volume, and it is convenient to carry and store after use. The pillow is filled with memory cotton to fit the human body and is comfortable for sleeping.

3 Claims, 18 Drawing Sheets

FOLDING BED

TECHNICAL FIELD

The invention relates to the field of furniture, and in particular to a folding bed.

BACKGROUND

As an indispensable household product, bed is the furniture that is commonly used for rest in modern families, but at present, most of the beds are large in size, occupy a wide area, and are inconvenient to move. It is hard for people to sleep and rest in the case of accompanying patients in hospitals or playing outside. Although some folding beds can alleviate the above problems, the current folding beds are still very large even after folding, inconvenient to carry and store.

SUMMARY

Objects of the invention: the invention discloses a folding bed. A frame body of the bed is constructed by simply connecting support rods, so that a double folding in a transverse direction and a longitudinal direction can be achieved, and after folding, the gap between the support rods can be sufficiently reduced, so as to minimize the volume, being convenient to carry and use, which greatly alleviates the problem that it is hard for people to sleep and rest on case of going out or taking lunch breaks.

Technical solutions: in order to achieve the above objects, the invention discloses a folding bed, comprising a mattress, a pillow, a bed frame comprising: a set of support rods A, a set of support rods B, a set of support rods C, a set of support rods D, a set of support rods E, a set of support rods F, a set of support rods G, a set of connecting pieces a, a set of connecting pieces b, a set of connecting pieces c, a set of connecting pieces d, a set of connecting pieces e, a set of connecting pieces f, connecting piece g, a set of connecting pieces h, connecting piece i, a set of connecting pieces j, a set of connecting pieces k, a set of connecting pieces l, connecting piece m, connecting piece n, tensioning straps, pins; the support structures on two sides of the folding bed are the same, being two left and right X-shaped support frames composed of support rods and connecting pieces, wherein the left X-shaped support frame is composed of two support rods B, the right X-shaped support frame is composed of one support rod B and one support rod D, the two X-shaped support frames are respectively connected and fixed at the upper and lower ends of the X-shape by a connecting piece k and a connecting piece c, and are connected and fixed at the central intersection point of the X-shape by a connecting piece b, the connecting piece b is simultaneously sleeved on a vertical support rod C, and a top end of the vertical support rod C is provided with a connecting piece j; wherein a connecting piece j on the left X-shaped support frame is connected to a support rod G and a support rod F; a connecting piece j on the right X-shaped support frame is connected to two support rods F; two support rods F on the two connecting pieces j are simultaneously connected to the connecting piece k connecting the two X-shaped support frames; at the same time, a connecting piece l is fixed on the two support rods C for supporting a connecting piece b sheathed on the support rods C; a connecting piece e is also sheathed and fixed on the two support rods C; the connecting piece e is connected to a connecting piece e symmetrically arranged on the other side of the folding bed using the tensioning strap; a connecting piece m is fixed on the support rod G on the left X-shaped support frame, the connecting piece m is simultaneously connected to the support rod B of the left X-shaped support frame; a connecting piece g is fixed on the right end of the right support rod F on the right X-shaped support frame, and the connecting piece g is simultaneously connected to the support rod D;

two side support structures of the folding bed are connected via three X-shaped support frames composed of support rods A; an intersection points of the X-shaped support frames are connected via the pin shafts; a lower end of the support rod A of the first X-shaped support frame is connected to the support rod B and the support rod A of the left X-shaped support frame of the folding bed respectively via a connecting piece a and a connecting piece f: an upper end thereof is connected and fixed to the support rod A, the support rod B and the support rod G respectively via a connecting piece m and a connecting piece n; an upper end of the support rod A of the second X-shaped support frame is connected and fixed to the connecting piece k, and a lower end thereof is connected to the connecting piece c;

one side of an upper end of the support rod A of the third X-shaped support frame is connected to the connecting piece g, the other side thereof is connected to the support rod A, the support rod F and the support rod D via the connecting piece i, and a lower end of the support rod A of the third X-shaped support frame is connected to the support rod A and the support rod B of the right X-shaped support frame via the connecting piece f and the connecting piece a respectively.

Preferably, the two vertical support rods C are respectively sheathed and fixed with a connecting piece d, the support rod B of the right X-shaped support frame is sheathed with a connecting piece h, the support rod B on a right side of the left X-shaped support frame is also sheathed with a connecting piece h, and the connecting piece d and the connecting piece h are both connected to the support rod E.

Preferably, the pillow is filled with memory cotton.

Preferably, the through-hole is provided on the support rod at a fixed connection of the connecting piece and the support rod, and is connected and fixed by a pin.

Advantageous effects of the invention: the invention may be folded longitudinally and transversely to form a columnar body after folding, which can sufficiently reduce the gap between the support rods, so as to minimize the volume, and which is convenient to carry and store after use. The pillow is filled with memory cotton to fit the human body and is comfortable for sleeping.

BRIEF DESCRIPTION OF DRAWINGS

In FIGS. 1-18: mattress 1, pillow 2, carriage bag 3, support rod A4, support rod B5, support rod C6, support rod D7, support rod E8, support rod F9, support rod G10, connecting piece a11, connecting piece b12, connecting piece c13, connecting piece d14, connecting piece e15, connecting piece f16, connecting piece g17, connecting piece h18, connecting piece i19, connecting piece j20, connecting piece k21, connecting piece l22, connecting piece m23, connecting piece n24, tensioning strap 25, pin 26.

DETAILED DESCRIPTION OF THE EMBODIMENTS

Hereinafter, the embodiments of the invention will be described clearly and completely with reference to the embodiments of the invention. It is to be understood that the described embodiments are only a few, but not all embodiments of the invention. Based on the embodiments of the invention, all other embodiments obtained by a person of ordinary skill in the art without inventive effort fall within the scope of the invention.

Figure 1:
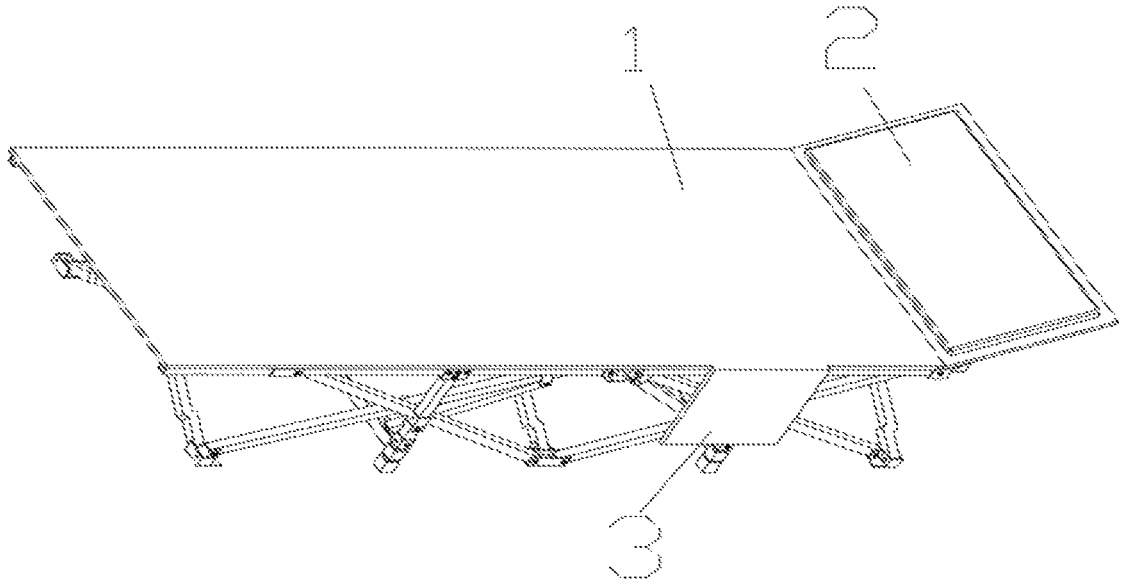
FIG. 1 is a schematic view showing the integral structure of the invention.
Figure 2:
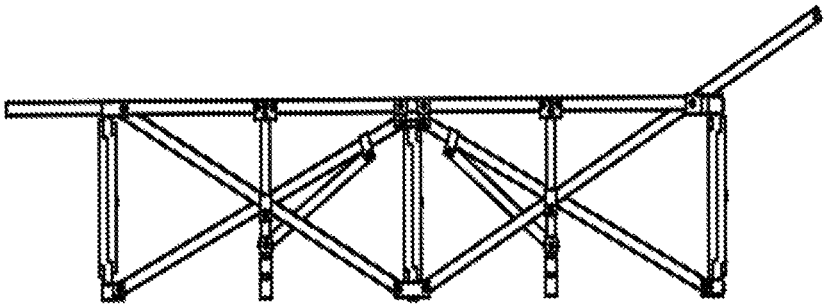
FIG. 2 is a schematic side view of the integral frame structure of the invention.
Figure 3:
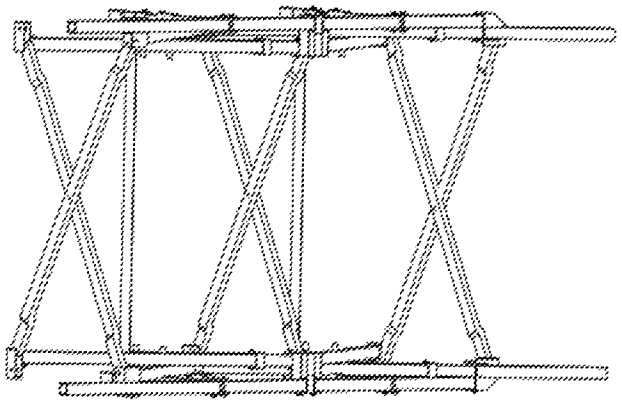
FIG. 3 is a longitudinal view of the integral frame structure of the invention.
Figure 4:
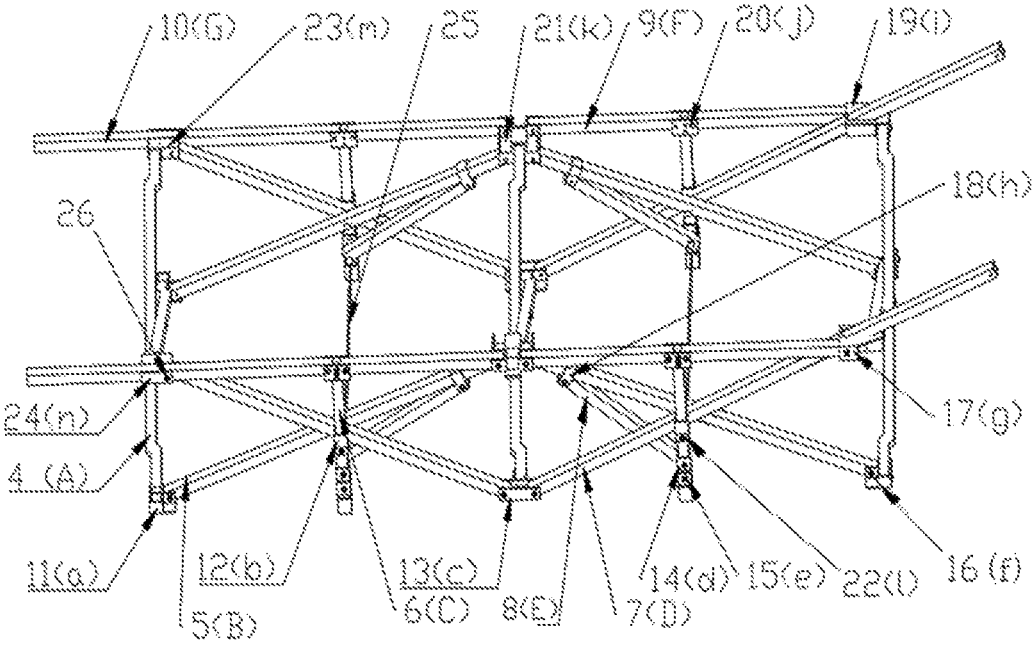
FIG. 4 is a schematic view of the integral frame structure of the invention.
Figure 5:
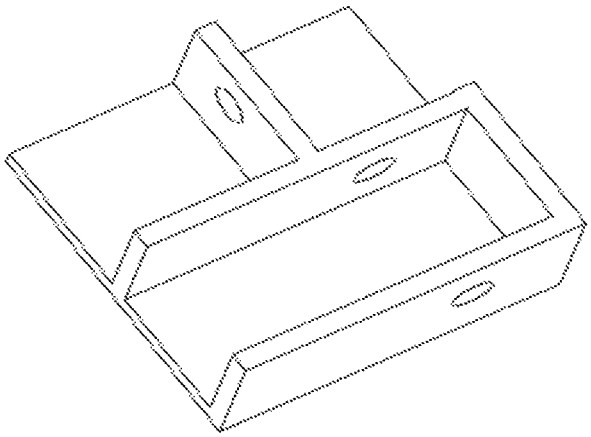
FIGS. 5-18 are schematic views of the structures of the connecting pieces a, b, c, d, e, f, g, h, i, j, k, l, m and n of the invention.
Figure 6:
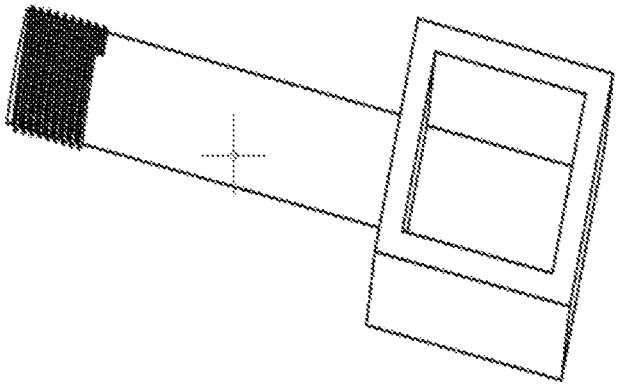
Figure 7:
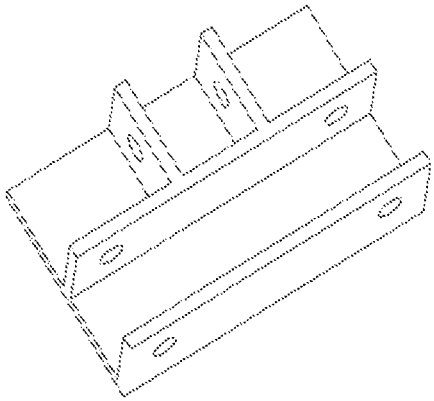
Figure 8:
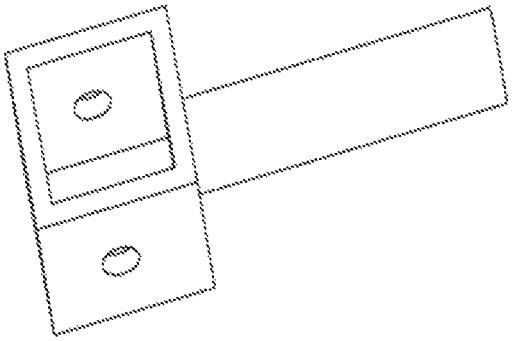
Figure 9:
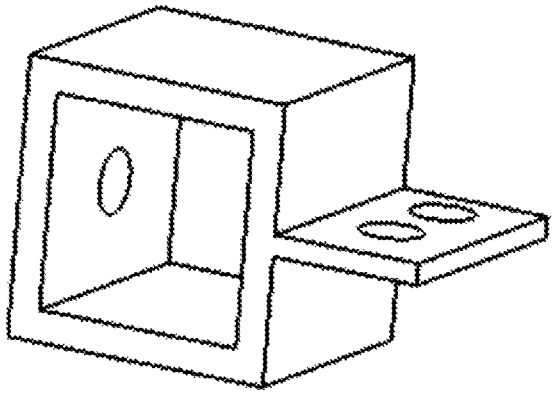
Figure 10:
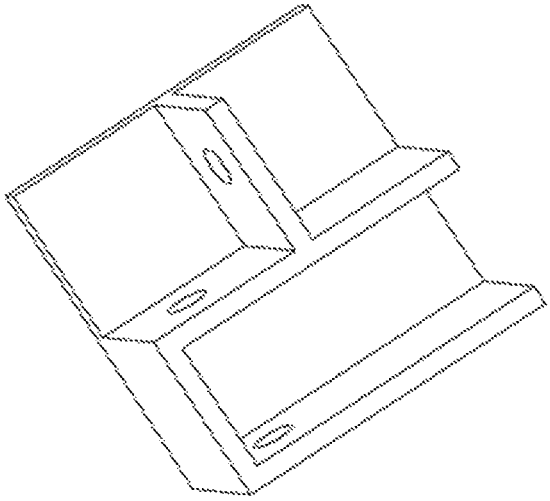
Figure 11:
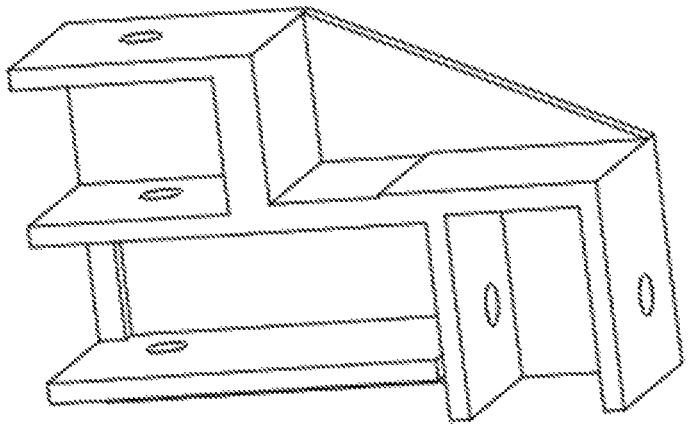
Figure 12:
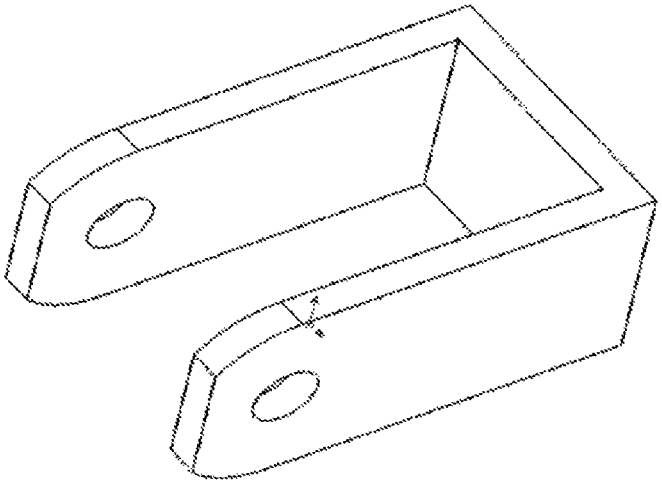
Figure 13:
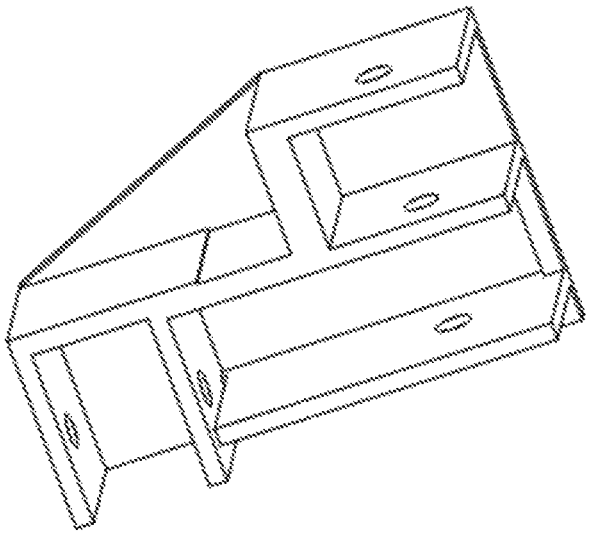
Figure 14:
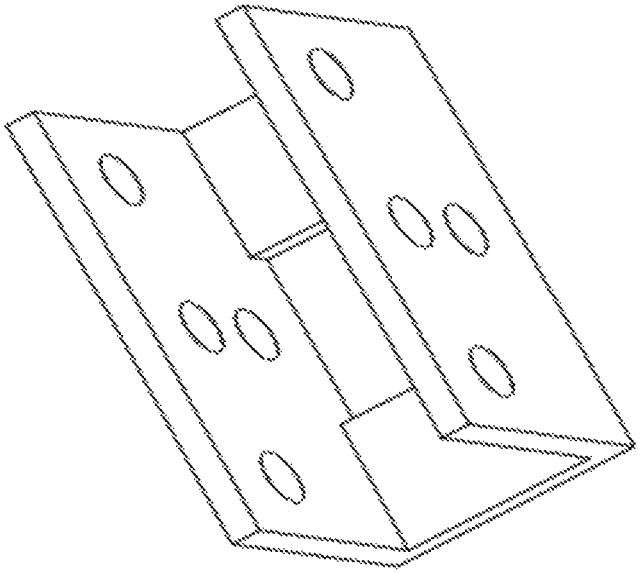
Figure 15:
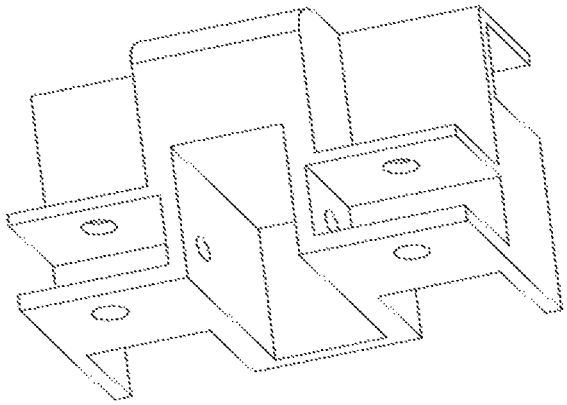
Figure 16:
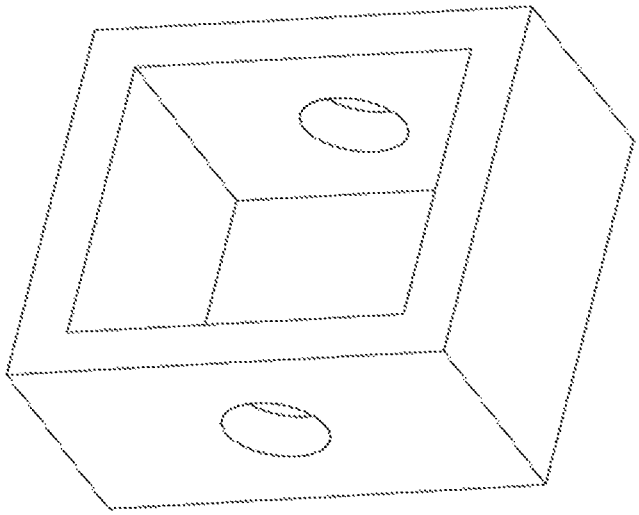
Figure 17:
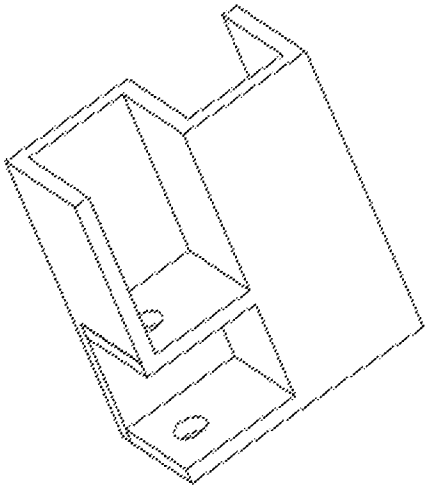
Figure 18:
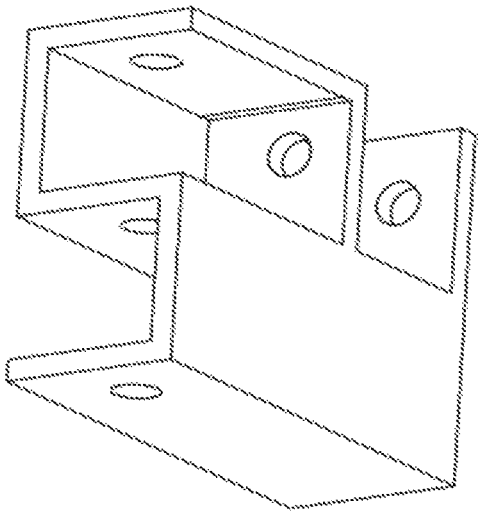

In FIG. 1, the mattress 1 is provided with a carriage bag 3, and the pillow 2 is filled with memory cotton and is fixed on the mattress 1.

In FIGS. 4-18, the support structures on two sides of the folding bed are the same, being two left and right X-shaped support frames composed of support rods and connecting pieces, wherein the left X-shaped support frame is composed of two support rods B5, the right X-shaped support frame is composed of one support rod B5 and one support rod D7; the two X-shaped support frames are respectively connected and fixed at the upper and lower ends of the X-shape by a connecting piece k21 and a connecting piece c13, and are connected and fixed at the central intersection point of the X-shape by a connecting piece b12, the connecting piece b12 is simultaneously sleeved on a vertical support rod C6; and a top end of the vertical support rod C6 is provided with a connecting piece j20, wherein the connecting piece j20 on the left X-shaped support frame is connected to the support rod G10 and the support rod F9; the connecting piece j20 on the right X-shaped support frame is connected to two support rods F9; two support rods F9 on the two connecting pieces j20 are simultaneously connected to the connecting piece k21 connecting the two X-shaped support frames; a connecting piece l22 is fixed on the two support rods C6 for supporting the connecting piece b12 sheathed on the support rods C6; and a connecting piece e15 is also sheathed and fixed on the two support rods C6; the connecting piece e15 is connected to a connecting piece e15 symmetrically arranged on the other side of the folding bed using a tensioning strap 25; a connecting piece m and a connecting piece m23 are fixed on the support rod G10 of the left X-shaped support frame and are simultaneously connected to the support rod B5 of the left X-shaped support frame; a connecting piece g17 is fixed on the right end of the support rod F9 on the right side of the right X-shaped support frame, and the connecting piece g17 is simultaneously connected to the support rod D7;

The two side support structures of the folding bed are connected via three X-shaped support frames composed of support rods A4; the intersection points of the X-shaped support frames are connected via the pin shafts; the lower end of the support rod A4 of the first X-shaped support frame is connected to the support rod B5 and the support rod A4 of the left X-shaped support frame of the folding bed respectively via a connecting piece a11 and a connecting piece f16; the upper end thereof is connected and fixed to the support rod A4, the support rod B5 and the support rod G10 respectively via a connecting piece m23 and a connecting piece n24; the upper end of the support rod A4 of the second X-shaped support frame is connected and fixed to the connecting piece k21, and the lower end thereof is connected to the connecting piece c13; one side of the upper end of the support rod A4 of the third X-shaped support frame is connected to the connecting piece g17, the other side is connected to the support rod A4, the support rod F9 and the support rod D7 with a connecting piece i19: and the lower end of the support rod A4 of the third X-shaped support frame is connected to the support rod A4 and the support rod B5 of the right X-shaped support frame via the connecting piece f16 and the connecting piece a11 respectively.

Preferably, the two vertical support rods C6 are respectively sheathed and fixed with a connecting piece d14, the support rod B5 of the right X-shaped support frame is sheathed with a connecting piece h18, the support rod B5 on the right side of the left X-shaped support frame is also sheathed with a connecting piece h18, and the connecting piece d14 and the connecting piece h18 are both connected to the support rod E8.

Preferably, the edges of the mattress 1 are connected and fixed to the support rod G10, the support rod F9 and the support rod D7.

Preferably, the pillow 2 is filled with memory cotton.

Preferably, the through-hole is provided on the support rod at the fixed connection of the connecting piece and the support rod, and is connected and fixed by a pin 26.

The folding bed of the invention may be folded longitudinally and transversely to form a columnar body after folding, which is convenient to carry and store. The pillow is filled with memory cotton to fit the human body and is comfortable for sleeping.

What is claimed is:

1. A folding bed, comprising a mattress, a pillow, and a bed frame, wherein the bed frame comprises: a first set of support rods (A), a second set of support rods (B), a third set of support rods (C), a fourth set of support rods (D), a fifth set of support rods (E), a sixth set of support rods (F), and a seventh set of support rods (G), a first set of connecting pieces (a), a second set of connecting pieces (b), a third set of connecting pieces (c), a fourth set of connecting pieces (c), a fourth set of connecting pieces (d), a fifth set of connecting pieces (e), a sixth set of connecting pieces (f), a first connecting piece (g), a seventh set of connecting pieces (h), a second connecting piece (i), an eight set of connecting pieces (j), a ninth set of connecting pieces (k), a tenth set of connecting pieces (l), a third connecting piece (m), a fourth connecting piece (n), tensioning straps, and pins; a pair of support structures formed on two sides of the folding bed by using a left X-shaped support frame and a right X-shaped support frame, the left X-shaped support frame is composed of two of the second set of support rods (B), the right X-shaped support frame is composed of one of the second set of support rods (B) and one of the fourth set of support rods (D), the left and right X-shaped support frames are respectively connected and fixed at the upper and lower ends of each of the support structure by using the ninth set of connecting pieces (k), and the third set of connecting pieces (c), and the left and right X-shaped support frames are connected and fixed at a central intersection point of the support structure by using the second set of connecting pieces (b) that is simultaneously sleeved vertically on the third set of support rods (C), and a top end of the third set of support rods (C) is provided with the eighth set of connecting pieces (j); wherein the eighth set of connecting pieces (j) on the left X-shaped support frame is connected to the seventh set of support rod (G) and the sixth set of support rod (F); the eighth set of connecting piece (j) on the right X-shaped support frame is connected to the sixth set of support rods (F); the sixth set of support rods (F) on the eighth set of connecting piece (j) are simultaneously connected to the ninth set of connecting pieces (k) for connecting the two X-shaped support frames; the tenth set of connecting pieces (l) is fixed on the third set of support rods (C) for supporting the second set of connecting pieces (b) sheathed on the third set of support rods (C); the fifth set of connecting pieces (e) is also sheathed and fixed on the third set of support rods (C) the fifth set of connecting pieces (e) is symmetrically arranged on other side of the folding bed using the tensioning straps; the third connecting piece (m) is fixed on the seventh set of support rods (G); on the left X-shaped support frame, the third connecting piece (m) is simultaneously connected to the second set of support rods (B) of the left X-shaped support frame; the first connecting piece (g) is fixed on a right end of a sixth set of support rods (F) of on the right X-shaped support frame, and the first connecting piece (g) is simultaneously connected to the fourth set of support rods (D); the pair of side support structures of the folding bed are connected via a first, a second and a third X-shaped support frames composed of the first set of support rods (A); an intersection points of the three X-shaped support frames are connected via pin shafts; a lower end of the first set of support rods (A), of the first X-shaped support frame is connected to the second set of support rods (B), and the first set of support rods (A), of the left X-shaped support frame of the folding bed respectively via the first set of connecting pieces (a) and the sixth set of connecting pieces (f) an upper end thereof is connected and fixed to the first set of support rods (A), the second set of support rods (B) and the seventh set of support rods (G); respectively via the third connecting piece (m) and the fourth connecting piece (n); an upper end of the first set of support rods (A), of the second X-shaped support frame is connected and fixed to the ninth set of connecting pieces (k), and a lower end thereof is connected to the third set of connecting pieces (c); one side of an upper end of the first set of support rods (A), of the third X-shaped support frame is connected to the first connecting piece (g), the other side thereof is connected to the first set of support rods (A), the sixth set of support rods (F) and the fourth set of support rods (D) via the second connecting piece, and a lower end of the first set of support rods (A), of the third X-shaped support frame is connected to the first set of support rods (A), and the second set of support rods (B) of the right X-shaped support frame via the sixth set of connecting pieces (f) and the first set of connecting pieces (a) respectively; a through-hole is provided on each support rod at a fixed connection of the respective connecting piece and the respective support rod, and is connected and fixed by one of the pins; the edges of the mattress are connected to the seventh set of support rods (G); the sixth set of support rods (F) and the fourth set of support rods (D).

2. The folding bed according to claim 1, wherein the two of the third set of support rods (C) are vertical that are respectively sheathed and fixed with the fourth set of connecting pieces (d), the second set of support rods (B) of the right X-shaped support frame is sheathed with the seventh set of connecting pieces (h), the second set of support rods (B) on a right side of the left X-shaped support frame is also sheathed with the seventh set of connecting pieces (h), and the fourth set of connecting pieces (d) and the seventh set of connecting pieces (h) are both connected to the fifth set of support rods (E).

3. The folding bed according to claim 1, wherein the pillow is filled with memory cotton.

* * * * *